US010947874B2

(12) United States Patent
Hartmann et al.

(10) Patent No.: US 10,947,874 B2
(45) Date of Patent: Mar. 16, 2021

(54) OIL CONTAINER OF A COMBUSTION ENGINE

(71) Applicant: MAN ENERGY SOLUTIONS SE, Augsburg (DE)

(72) Inventors: Daniel Hartmann, Niederstotzingen (DE); Peter Druckmiller, Kutzenhausen (DE)

(73) Assignee: MAN Energy Solutions SE, Augsburg (DE)

( * ) Notice: Subject to any disclaimer, the term of this patent is extended or adjusted under 35 U.S.C. 154(b) by 0 days.

(21) Appl. No.: 16/341,739

(22) PCT Filed: Sep. 26, 2017

(86) PCT No.: PCT/EP2017/074301
§ 371 (c)(1),
(2) Date: Apr. 12, 2019

(87) PCT Pub. No.: WO2018/069034
PCT Pub. Date: Apr. 19, 2018

(65) Prior Publication Data

US 2020/0049038 A1 Feb. 13, 2020

(30) Foreign Application Priority Data

Oct. 13, 2016 (DE) ..... 102016119507.3

(51) Int. Cl.
*F01M 11/06* (2006.01)
*F01M 11/00* (2006.01)

(52) U.S. Cl.
CPC ..... *F01M 11/064* (2013.01); *F01M 11/0004* (2013.01); *F01M 11/061* (2013.01); *F01M 2011/0041* (2013.01)

(58) Field of Classification Search
CPC ..... F01M 11/064; F01M 11/0004; F01M 2011/0041; F01M 11/061
See application file for complete search history.

(56) References Cited

U.S. PATENT DOCUMENTS 2,938,601 A * 5/1960 Brafford ..... F01M 11/065 184/103.1
2008/0295797 A1* 12/2008 Randall ..... B01D 53/78 123/25 G
2011/0120805 A1 5/2011 Michel et al.

FOREIGN PATENT DOCUMENTS

DE 10 2011 018401 4/2012
DE 10 2014 001965 8/2015
(Continued)

OTHER PUBLICATIONS

Office Action dated Mar. 2, 2020 issued in Japanese Patent Application No. 2019-515938.
(Continued)

*Primary Examiner* — Jacob M Amick
*Assistant Examiner* — Charles Brauch
(74) *Attorney, Agent, or Firm* — Cozen O'Connor

(57) ABSTRACT

An oil container of a combustion engine. Oil collected in the oil container can be, conveyed to the combustion engine and back into the oil container, having a central oil chamber out of which oil can be suctioned and lateral oil chambers positioned either obliquely above or obliquely below the central oil chamber depending on an oblique position of the oil container. Oil is directed to the lateral oil chambers from the combustion engine, and, depending on the oblique position of the oil container, the central oil chamber can be coupled to a first lateral oil chamber that is adjacent to the central oil chamber on a first side of the central oil chamber, or to a second lateral oil chamber that is adjacent to the
(Continued)

central oil chamber on a second side of the central oil chamber, via a respective passively controlled check valve.

10 Claims, 1 Drawing Sheet

(56) References Cited

FOREIGN PATENT DOCUMENTS

| | | |
|---|---|---|
| DE | 10 2014 001966 | 8/2015 |
| JP | S 53-041655 | 4/1978 |
| JP | 60-105809 | 7/1985 |
| JP | S 62-016711 | 1/1987 |
| JP | 62-175208 | 11/1987 |
| JP | S 63-105268 | 5/1988 |
| JP | H 01-166205 | 11/1989 |
| WO | WO 2010/010042 | 1/2010 |

OTHER PUBLICATIONS

Office Action dated Apr. 2, 2020 issued in Korean Patent Application No. 10-2019-7013503.
Office Action dated Jul. 3, 2020 issued in Chinese Patent Application No. 201780063419.3.

* cited by examiner

OIL CONTAINER OF A COMBUSTION ENGINE

CROSS REFERENCE TO RELATED APPLICATIONS

This is a U.S. national stage of application No. PCT/EP2017/074301, filed on Sep. 26, 2017. Priority is claimed on German Application No. DE102016119507.3, filed Oct. 13, 2016, the content of which is incorporated here by reference.

BACKGROUND OF THE INVENTION

1. Field of the Invention

The invention relates to an oil reservoir of an internal combustion engine.

2. Description of the Prior Art

An internal combustion engine typically comprises an oil reservoir designed as an oil pan, in which oil, which serves for the lubrication and if applicable cooling of assemblies of an internal combustion engine, can be collected. Emanating from the oil reservoir, the oil collected in the oil reservoir can be fed to the relevant assemblies of the internal combustion engine for lubrication and if applicable cooling. Following this, the oil, emanating from the respective assemblies of the internal combustion engine, can be conducted back into the oil reservoir. In the case of an internal combustion engine, the oil from the internal combustion engine either drains directly downwards from the internal combustion engine into the oil reservoir or the oil is transported via a pipe from the internal combustion engine in the direction of the oil reservoir. In particular in applications on board of a ship it is required that an internal combustion engine installed there can also continue operation even in inclined positions.

From DE 10 2014 001 965 A1 and from DE 10 2014 001 966 A1, oil reservoirs in each case for an internal combustion engine installed on a ship are known, which ensure an oil supply of the internal combustion engine with a permanently unchanged inclined position of the oil reservoir. There, the oil reservoir is subdivided into a central oil chamber and lateral oil chambers, wherein oil from the lateral oil chambers is delivered into the central oil chamber with the help of pumps, so that in the central oil chamber, from which oil is suctioned in the direction of the internal combustion engine, can be suctioned even with a permanently unchanged inclined position of the oil reservoir or of the internal combustion engine.

As already explained, the oil reservoirs known from the prior art ensure a secure supply of the internal combustion engine with oil, emanating from the oil reservoir, with a permanently unchanged inclined position of the oil reservoir and thus of the internal combustion engine. However, the oil reservoirs known from the prior art are elaborate in design. There is therefore a need for an oil reservoir of a simpler design, which in the case of inclined positions that change in cycles, makes possible a defined oil supply of the internal combustion engine.

SUMMARY OF THE INVENTION

One aspect of the present invention is based on creating a new type of oil reservoir of an internal combustion engine.

Dependent on the inclined position of the oil reservoir, the central oil chamber can be coupled according to the invention to a first lateral oil chamber, which adjoins the central oil chamber on a first side of the central oil chamber, or to a second lateral oil chamber, which adjoins the central oil chamber on a second side of the central oil chamber, via in each case at least one passively controlled check valve.

The oil reservoir according to one aspect of the invention utilises passively controlled check valves and thus manages to get by without pumps. Compared with the oil reservoirs known from the prior art, the oil reservoir according to the invention therefore is of a significantly simpler construction. In particular when the inclined positions of the oil reservoir change in cycles, a reliable, defined oil supply of the internal combustion engine can be ensured with such an oil reservoir.

Preferentially, the respective check valve is oil pressure-controlled and gravity-controlled. Such check valves, which are oil pressure-controlled and gravity-controlled, are controlled purely passively are particularly simple and effective.

According to an advantageous further development, the central oil chamber is closed at the top. By way of this it is ensured that as a consequence of an inclined position, no oil can escape from the central oil chamber at the top. By way of this the oil supply of the internal combustion engine emanating from the oil reservoir can be further improved.

According to an advantageous further development, each of the lateral oil chambers is subdivided into multiple part oil chambers. Preferentially, each of the lateral oil chambers is subdivided into an inner lateral part oil chamber and at least one outer lateral part oil chamber. Part oil chambers adjoining one another are coupled via separating walls with permanently open and thus oil-permeable recesses. The respective inner lateral part oil chamber of the respective lateral oil chambers can be coupled to the central oil chamber in each case via at least one of the passively controlled check valves. By subdividing the lateral oil chambers into part oil chambers, the oil supply of the internal combustion engine, emanating from the oil reservoir, can be further improved.

Preferentially, the respective inner lateral part oil chamber of the respective lateral oil chambers is closed at the top. At least the respective outer lateral part oil chamber of the respective lateral oil chamber, which is located the furthest away from the central oil chamber, is open at the top. By closing the inner lateral part oil chambers, the oil supply of the internal combustion engine, emanating from the oil reservoir, is further improved. By way of the outer lateral part oil chambers, the oil can flow back into the oil reservoir. The oil emanating from the internal combustion engine and flowing back into the oil reservoir is initially calmed in the lateral oil chambers and only subsequently flows in the direction of the internal combustion engine via the central oil chamber.

BRIEF DESCRIPTION OF THE DRAWINGS

Preferred further developments of the invention are obtained from the subclaims and the following description. Exemplary embodiments of the invention are explained in more detail by way of the drawing without being restricted to this. There it shows:

DETAILED DESCRIPTION OF THE PRESENTLY PREFERRED EMBODIMENTS

The invention relates to an oil reservoir for an internal combustion engine. The oil reservoir according to one aspect of the invention is employed in particular with an internal combustion engine installed on a ship.

Figure 1:
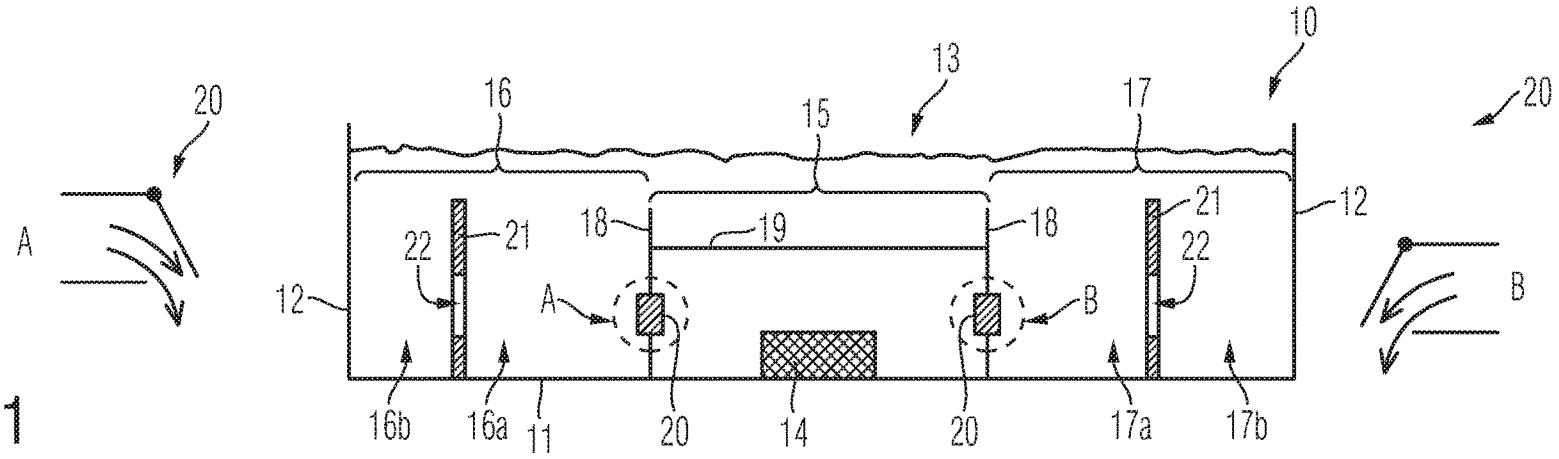
FIG. 1 is a schematised cross section through an oil reservoir in a normal position.
Figure 2:
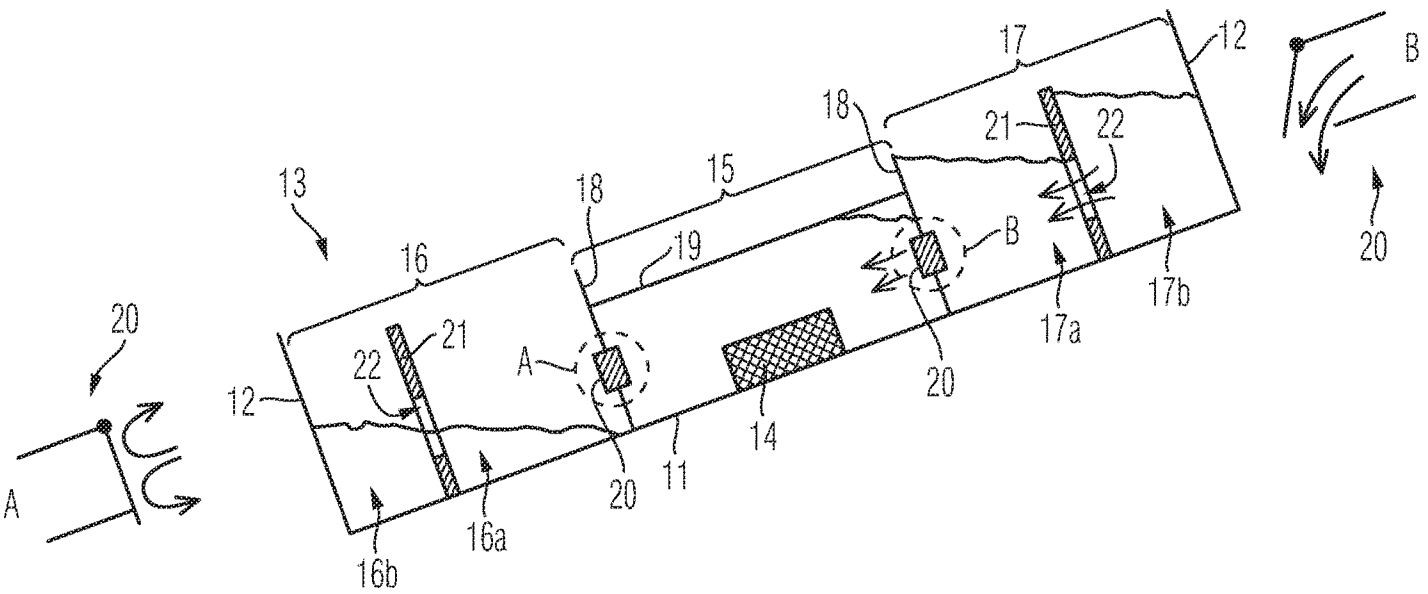
FIG. 2 is a schematised cross section through an oil reservoir according in an inclined position.

FIGS. 1 and 2 each show a schematised cross section through an oil reservoir 10 of an internal combustion engine according to one aspect of the invention. The oil reservoir 10 is delimited by a bottom wall 11 and side walls 12, wherein the bottom wall 11 and the side walls 12 of the oil reservoir 10 delimit a receiving space 13 for oil. In the oil reservoir 10, namely in the receiving space 13, oil is kept ready, which can be removed from the oil reservoir 10 for lubrication and if applicable cooling of the internal combustion engine. FIGS. 1 and 2 show a suction opening 14 of a suction pipe, via which oil can be suctioned from the oil reservoir 10 and delivered in the direction of the internal combustion engine. Emanating from the internal combustion engine, the oil can be returned into the oil reservoir 10, namely into the receiving space 13, wherein for this purpose the oil reservoir 10 is embodied open at the top located opposite the bottom wall 11.

The oil reservoir 10 comprises a central oil chamber 15 and lateral oil chambers 16 and 17 adjoining on both sides of the central oil chamber 15. According to FIGS. 1 and 2, the suction opening 14, via which oil can be suctioned from the oil reservoir 10, is assigned to the central oil chamber 15 so that the oil via the suction opening 14 can be suctioned from the central oil chamber 15 and delivered towards the internal combustion engine.

As already explained, a lateral oil chamber 16, 17 each is arranged on both sides of the central oil chamber 15. Dependent on an inclined position of the oil reservoir 10, the lateral oil chambers 16, 17 are positioned either obliquely above or alternatively obliquely below the central oil chamber 15. FIG. 1 shows the oil reservoir 10 in a normal position, i.e. without inclined position. In the inclined position of FIG. 2, the lateral oil chamber 16 is arranged obliquely below and the lateral oil chamber 17 obliquely above the central oil chamber 15.

Oil which, emanating from the internal combustion engine, is returned in the direction of the oil reservoir 10, can be returned emanating from the internal combustion engine into the lateral oil chambers 16, 17.

The central oil chamber 15 is separated by separating walls 18 from the lateral oil chambers 16, 17 adjoining the same.

In the shown preferred exemplary embodiment, the central oil chamber 15 is closed at the top, located opposite the bottom wall 11, by a lid wall 19 (an open central oil chamber is likewise possible).

Dependent on the inclined position of the oil reservoir 10, the central oil chamber 15 is coupled to the lateral oil chamber 16, which is arranged on a first side of the central oil chamber 15, or to the lateral oil chamber 17, which is arranged on a second side of the central oil chamber 11 located opposite, via a respective at least one passively controlled check valve 20.

The respective passively controlled check valve 20 is integrated in the respective separating wall 18 between the central oil chamber 15 and the respective adjoining lateral oil chamber 16, 17.

In particular when the oil reservoir 10 assumes the normal position shown in FIG. 1, the check valves 20 are typically half open. Oil flows from the lateral chambers into the middle chamber.

In the inclined position of FIG. 2, the or each check valve 20, which is assigned to the separating wall 18 between the central oil chamber 15 and the lateral oil chamber 16, is closed, whereas the or each check valve 20, which is assigned to the separating wall 18 between the central oil chamber 15 and the lateral oil chamber 17, is open, so that emanating from the lateral oil chamber 17 positioned obliquely above the central oil chamber 15, oil can flow from the lateral oil chamber 17 into the central oil chamber 15. Because of the fact that the central oil chamber 15 is preferentially closed at the top by the lid wall 19 it is prevented that as a consequence of the inclined position, oil from the central oil chamber 15 flows into the lateral oil chamber 16 arranged in FIG. 2 laterally obliquely below the same.

In particular when the oil reservoir 10 of FIG. 2, compared with FIG. 2, is inclined towards the other side, i.e. the lateral oil chamber 16 is arranged obliquely above and the lateral oil chamber 17 obliquely below the central oil chamber 15, the or each of the check valve 20 assigned to the separating wall 18 positioned between the lateral oil chamber 16 and the central oil chamber 15 is open, so that the oil, emanating from the lateral oil chamber 16, can then flow into the central oil chamber 15. In this case, the or each check valve 20, which is assigned to the separating wall 18 between the central oil chamber 15 and the lateral oil chamber 17 is then closed.

In FIGS. 1 and 2, the details A and B are shown laterally next to the oil reservoir 10, whereas in FIG. 1, according to the details A and B, both passive check valves 20 are half open, whereas in FIG. 2 according to the detail A a check valve 20 is closed and according to the detail B the other check valve 20 is open.

As already explained, the check valves 20 are passively controlled. In particular, the check valves are oil pressure-controlled and gravity-controlled. Dependent on the pressure differential of the oil pressure in the oil chambers 15 and 16 as well as 15 and 17 adjoining one another and dependent on the inclined position of the oil reservoir 10 and the gravity that is active as a consequence of the inclined position, the check valves 20 are accordingly open or closed.

In the shown preferred exemplary embodiment, each of the lateral oil chambers 16, 17 is subdivided into multiple part oil chambers 16*a*, 16*b* and 17*a*, 17*b* respectively. Accordingly, in the exemplary embodiment of FIGS. 1 and 2, each of the lateral oil chambers 16, 17 is subdivided into two part oil chambers 16*a*, 16*b* and 17*a*, 17*b* respectively, namely into an inner lateral part oil chamber 16*a*, 17*a* and an outer lateral part oil chamber 16*b*, 17*b*. Multiple outer lateral part oil chambers 16*b*, 17*b* can also be arranged laterally next to one another in a row.

The inner lateral part oil chambers 16*a*, 17*a* adjoin the central oil chamber 15 and are separated from the same by the separating walls 18 and the passively controlled check valves 20 or coupled by the passively controlled check valves 20. The inner part oil chambers 16*a*, 17*a* are separated from the adjoining outer part oil chambers 16*b*, 17*b* by separating walls 21, wherein permanently open and thus permanently oil-permeable recesses 22 are produced into these separating walls 21. Between the part oil chambers 16*a*, 16*b* and 17*a*, 17*b* respectively of the lateral oil chambers 16, 17, oil can permanently flow via the permanently open and thus permanently oil-permeable recesses 22, namely dependent on the inclined position of the oil reservoir 10.

In the shown exemplary embodiment of FIGS. 1 and 2, merely the central oil chamber 15 is closed on the top located opposite the bottom wall 11 by the lid wall 19, the lateral oil chambers 16, 17 are completely open at the top, i.e. in the region of both part oil chambers 16*a*, 16*b* and 17*a*, 17*b* respectively.

In contrast with the exemplary embodiment of FIGS. 1 and 2 it is also possible that the inner lateral part oil chambers 16*a*, 17*a*, which directly adjoin the central oil chamber 15, located opposite the bottom wall 11, are closed at the top by a lid wall (not shown). In this case, the lateral outer part oil chambers 16*b*, 17*b* which are located the furthest away from the central oil chamber 15, are then designed open at the top in FIGS. 1 and 2, so that oil, which emanating from the internal combustion engine flows back in the direction of the oil reservoir 10, initially flows via the outer lateral part oil chambers 16*b*, 17*b* and subsequently via the inner lateral part oil chambers 16*a*, 17*a* and only then enters the region of the central oil chamber 15. Because of this, the oil emanating from the internal combustion engine and flowing back into the region of the oil reservoir 10 is calmed, as a result of which a particularly advantageous supply of the internal combustion engine with lubricating oil or cooling oil is possible.

The oil reservoir 10 according to the invention has a simple design structure and utilises passively controlled check valves 20. No actively controlled assemblies such as for example pumps are required. With the oil reservoir 10 according to the invention a secure supply to the internal combustion engine of cooling oil or lubricating oil can be ensured with cyclically changing inclined positions of the oil reservoir 10.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An oil reservoir of an internal combustion engine, oil that is collected in the oil reservoir and can be removed from the oil reservoir for at least one of lubrication and cooling of the internal combustion engine and delivered in a direction of the internal combustion engine and subsequently returned from the internal combustion engine into the oil reservoir, the oil reservoir and comprising:

a central oil chamber defined by at least a first wall and a second wall, from which the oil can be suctioned and delivered in the direction of the internal combustion engine;

at least two lateral oil chambers, which dependent on an inclined position of the oil reservoir, are positioned either obliquely above or alternatively obliquely below the central oil chamber, wherein the oil, emanating from the internal combustion engine, is returned into the at least two lateral oil chambers, at least one first passively controlled check valve arranged in the first wall and configured to couple a first lateral oil chamber, which adjoins the central oil chamber on a first side of the central oil chamber, to the central oil chamber dependent on the inclined position of the oil reservoir; and at least one second passively controlled check valve arranged in the second wall and configured to couple a second lateral oil chamber, which adjoins the central oil chamber on a second side of the central oil chamber opposite the first side, to the central oil chamber dependent on the inclined position of the oil reservoir, wherein each of the first and second lateral oil chambers is subdivided into an inner lateral part oil chamber and at least one outer lateral part oil chamber, and wherein the part oil chambers adjoining one another are coupled via separating walls that are permanently open with oil-permeable recesses.

2. The oil reservoir according to claim 1, wherein at least one of the first and second check valve is oil pressure-controlled.

3. The oil reservoir according to claim 1, wherein at least one of the first and second check valve is gravity-controlled.

4. The oil reservoir according to claim 1, wherein the central oil chamber is closed at a top.

5. The oil reservoir according to claim 1, wherein each of the at least two lateral oil chambers is subdivided into multiple part oil chambers.

6. The oil reservoir according to claim 1, wherein the respective inner lateral part oil chamber of the respective lateral oil chamber can be coupled to the central oil chamber via at least one of the respective check valves, which are each passively controlled.

7. The oil reservoir according to claim 6, wherein the respective inner lateral part oil chamber of the respective lateral oil chamber is closed at the top.

8. The oil reservoir according to claim 1, wherein at least the respective outer lateral part oil chamber of the respective lateral oil chamber, which is located the furthest away from the central oil chamber, is open at the top.

9. The oil reservoir according to claim 1, wherein the internal combustion engine, is an internal combustion engine installed on a ship.

10. The oil reservoir according to claim 1, wherein the first and second check valve are normally half open.

* * * * *